United States Patent [19]

Koike et al.

[11] Patent Number: 5,014,091

[45] Date of Patent: May 7, 1991

[54] PAPER JOGGING AND ALIGNING APPARATUS WITH STAPLING CAPABILITIES FOR A COPYING MACHINE

[75] Inventors: Tadao Koike; Koichi Noguchi, both of Tokyo; Hiroshi Takahashi, Kawasaki; Koichi Tsunoda, Yokohama, all of Japan

[73] Assignee: Ricoh Company, Ltd., Tokyo, Japan

[21] Appl. No.: 446,724

[22] Filed: Dec. 6, 1989

[30] Foreign Application Priority Data

Dec. 7, 1988 [JP] Japan ..... 63-309559

[51] Int. Cl.[5] ..... G03G 21/00

[52] U.S. Cl. ..... 355/321; 271/223; 355/324

[58] Field of Search ..... 355/321, 322, 324; 227/40, 50, 99; 271/221, 223, 224, 241; 270/53

[56] References Cited

U.S. PATENT DOCUMENTS

| | | | |
|---|---|---|---|
| 3,893,665 | 7/1975 | Greene | 271/221 |
| 4,073,391 | 2/1978 | O'Brien et al. | 271/221 X |
| 4,134,672 | 1/1979 | Burlew et al. | 227/3 X |
| 4,395,036 | 7/1983 | Bergman et al. | 271/223 X |
| 4,611,741 | 9/1986 | Wilson | 227/99 |
| 4,697,911 | 10/1987 | Kajita et al. | 355/322 X |

FOREIGN PATENT DOCUMENTS

| | | | |
|---|---|---|---|
| 0143853 | 8/1984 | Japan | 271/221 |

*Primary Examiner*—A. T. Grimley
*Assistant Examiner*—Nestor R. Ramirez
*Attorney, Agent, or Firm*—Oblon, Spivak, McClelland, Maier & Neustadt

[57] ABSTRACT

A paper handling device for an image forming apparatus accurately positions paper sheets having been driven out of the apparatus with their center being in register with a reference at a predetermined position for executing stapling or similar processing. The device shifts the discharged paper sheets to a one-side reference position while truing them up at a center reference position. Therefore, the paper sheets are located at the one-side reference position with accuracy and thereby stapled or otherwise processed accurately. The device simplifies the movement of an instrument for implementing such processing. A stack of discharged sheets, whether they are so processed or not, can be readily taken out from the device with no regard to the paper size. A pair of paper guide members urge paper sheets in such a manner as to enhance further accurate positioning of the latter.

4 Claims, 6 Drawing Sheets

PAPER JOGGING AND ALIGNING APPARATUS WITH STAPLING CAPABILITIES FOR A COPYING MACHINE

BACKGROUND OF THE INVENTION

The present invention relates to a paper handling device for use in an image forming apparatus.

A copier, facsimile machine, printer or similar image forming apparatus is often constructed to discharge a paper sheet undergone an image forming sequence by positioning the widthwise center of the paper sheet at a center reference with no regard to the paper size. When paper sheets sequentially driven out of the apparatus in such a position are to be bound by a stapler, for example, the position of their margins differs from one paper size to another. It has been customary to cope with this situation by shifting a stapler in the widthwise direction of paper sheets in matching relation to the paper size. In addition, when paper sheets are discharged from the apparatus, a stapler is usually retracted from a stapling position in a direction perpendicular to the widthwise direction. A stapler, therefore, has to be moved two-dimensionally in a complicated manner and needs a disproportionately complicated arrangement for switching over the position thereof. Further, when the layout of the apparatus is such that paper sheets are taken out in a direction perpendicular to the paper discharging direction, it is not easy to remove paper sheets having comparatively small sizes.

SUMMARY OF THE INVENTION

It is therefore an object of the present invention to provide a paper handing device for an image forming apparatus of the type discharging paper sheets by positioning their center at a center reference, which device is capable of accurately positioning paper sheets driven out of the apparatus at a stapling or similar processing position.

It is another object of the present invention to provide a paper handing device which simplifies the movement of a stapler or similar processing instrument.

It is another object of the present invention to provide a paper handing device which allows discharged paper sheets to be taken out with ease.

It is another object of the present invention to provide a generally improved paper handling device for an image forming apparatus.

A paper handling device for an image forming apparatus of the present invention comprises a tray for receiving a plurality of paper sheets sequentially driven out of the image forming apparatus while being positioned with the widthwise center of the paper sheets being located at a center reference, and a pair of paper guide members movable relative to the tray. The paper guide members are moved symmetrically toward each other with respect to the widthwise center to located the paper sheets on the tray at a center reference position while moving the paper sheets in a direction for truing up one longitudinal edge of the paper sheets. Either one of the paper guide members moves, when a plurality of paper sheets have been fully discharged, the paper sheets such that one lateral edge of the paper sheets coincides with a one-side reference position which is common to all paper sizes, while the other paper guide member moves away from the one lateral edge.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
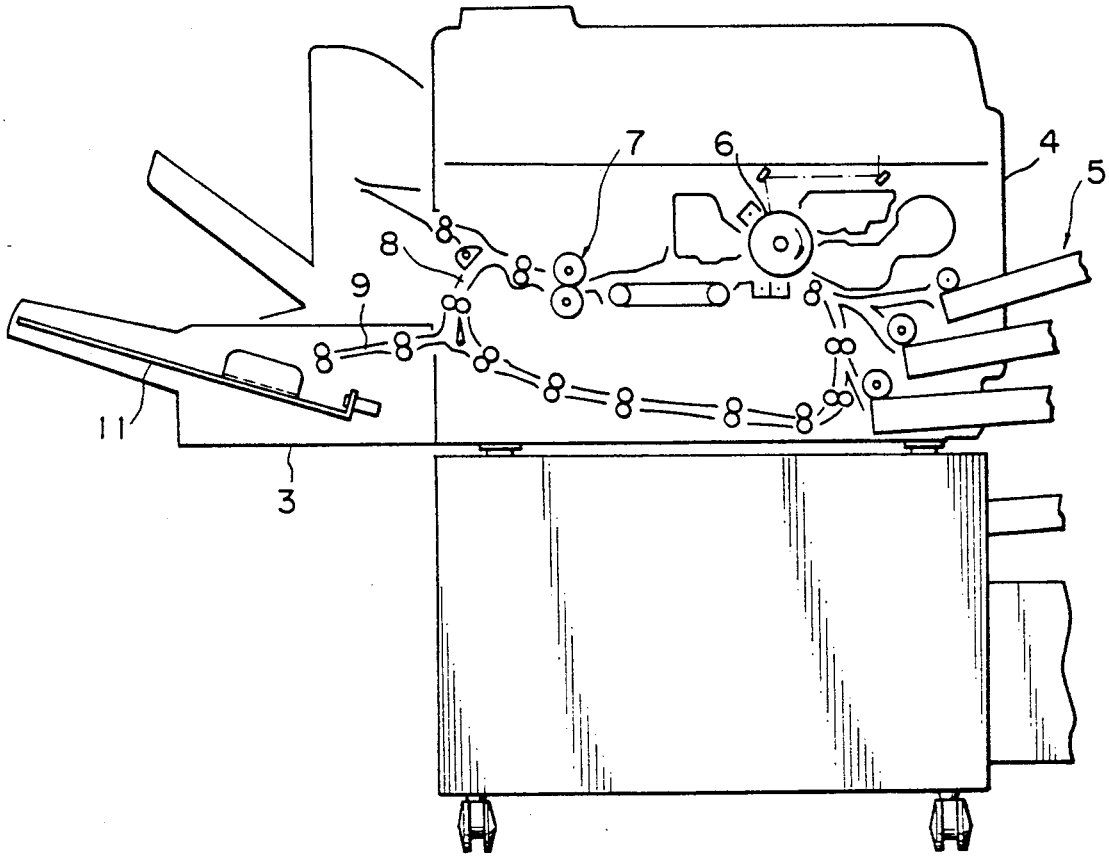
FIG. 1 is a schematic view of a copier to which a paper handling device embodying the present invention is applied.

Referring to FIG. 1 of the drawings, a copier having a paper handling apparatus embodying the present invention is shown. As shown, a paper sheet is fed from a paper feeding section 5 to a photoconductive element 6 which is implemented as a drum by way of example. After a toner image has been transferred from the drum 6 to the paper sheet, the paper sheet is transported through a fixing unit 7 and paper discharge paths 8 and 9 to a tray 11. A paper handling device 3 includes the paper transport paths 8 and 9 and tray 11 and, in this sense, it serves as a paper tray device which receives a paper sheet coming out of the copier body 4. As FIG. 1 indicates, the tray 11 is inclined such that its end adjacent to the copier body 4 is positioned at the lowest level. In this position, the tray 11 accommodates a plurality of paper sheets which are discharged from the copier body 4 with their widthwise center being in register with a center reference with no regard to the paper size.

Figure 2:
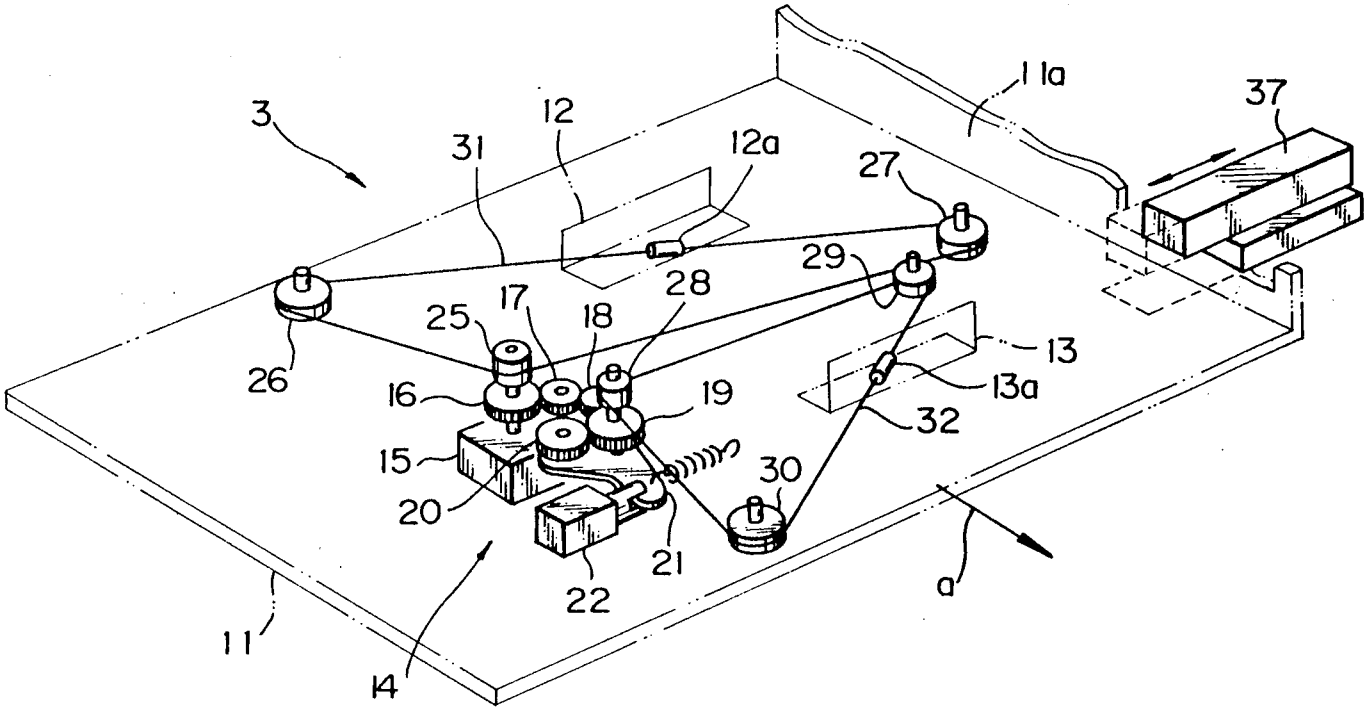
FIG. 2 is a perspective view showing a specific construction for driving jogger fences included in the paper handling device.

Referring to FIG. 2, a pair of jogger fences 12 and 13 which are a specific form of paper guide members are mounted on the tray 11 in such a manner as to be movable toward and away from each other. A mechanism 14 is arranged on the back of the tray 11 for driving the jogger fences 12 and 13. The mechanism 14 includes a motor 15, a drive gear 16, gears 17, 18, 19 and 20, a gear mount 21, and a solenoid 22. Only the jogger fences 12 and 13 are present on the upper surface of the tray 11, i.e., all the other components are arranged on the underside of the tray 11. A pulley 25 is provided integrally and coaxially with the drive gear 16. An endless wire 31 is passed over the pulley 25 and idle pulleys 26 and 27. The jogger fence 12 is anchored to the wire 31 through a retaining portion 12*a*. A similar wire 32 is passed over a pulley 28 which is coaxial with the gear 19, and idle pulleys 29 and 30. The jogger fence 13 is retained by the wire 32 through a retaining portion 13*a*.

Figure 3:
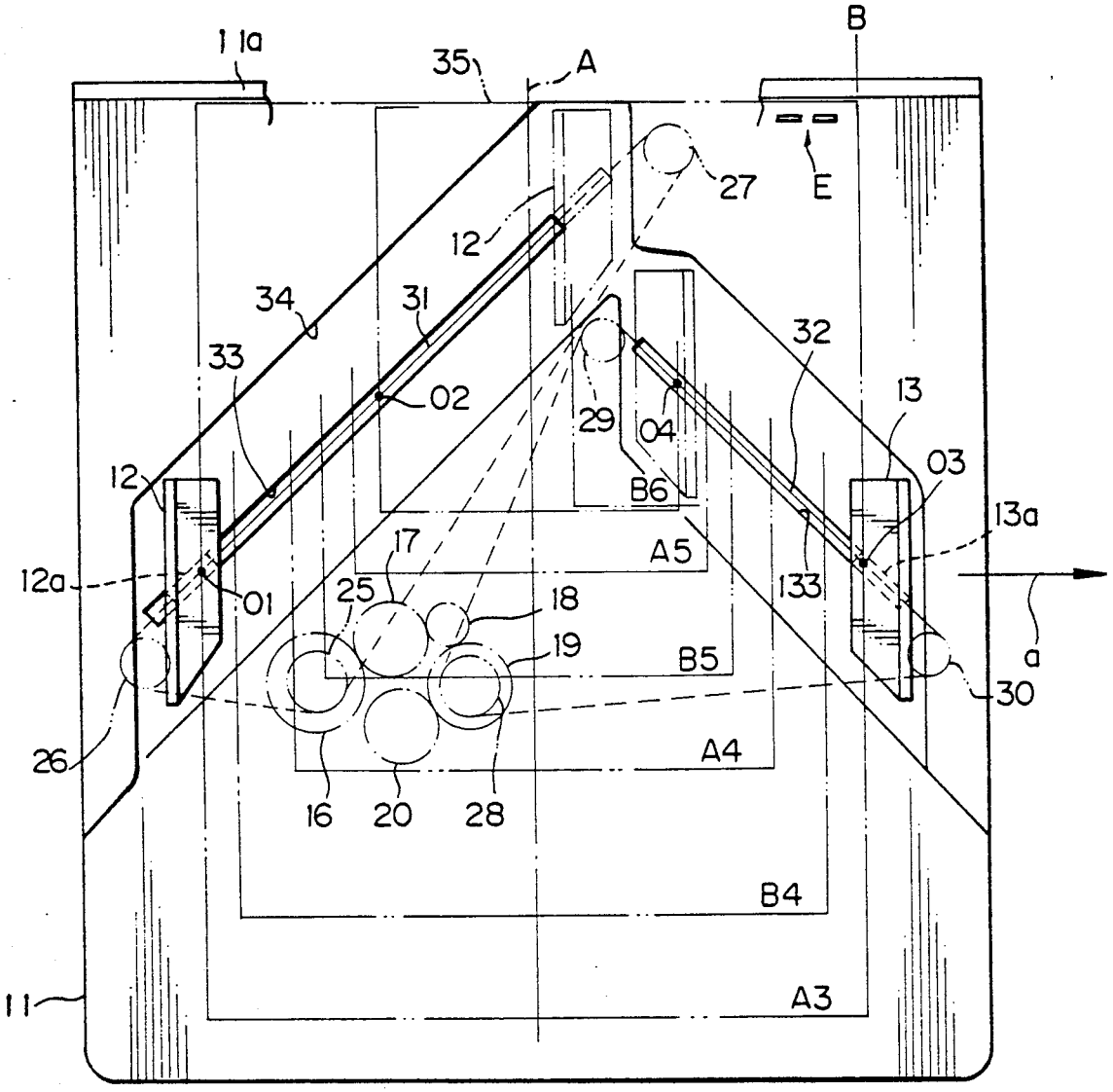
FIG. 3 is a plan view of the construction shown in FIG. 2.

As shown in FIG. 3, guide slots 33 and 13 are formed through the tray 11 and receive therein the retaining portions 12*a* and 13*a*, respectively. The tray 11 has a stepped portion 34 in an area thereof in which the jogger fence 12 moves. The stepped portion 34 is lower in level than the upper surface of the tray 11.

In the illustrative embodiment, paper sheets of six different sizes, i.e., B6 to A3 may be discharged from the copier body 4 onto the tray 11 with their widthwise center A being used for a reference, as shown in FIG. 3. The discharged paper sheets are neatly regulated, or trued up, at their one longitudinal edge 35 by the operation which will be described.

The directions in which the jogger fences 12 and 13 are movable are as follows. As shown in FIG. 3, the jogger fence 12 is movable along a line which interconnects the intermediate point $O_1$ of one lateral edge of a paper sheet having the largest size (A3) and a point $O_2$ of one lateral edge of a paper sheet having the smallest size (B6). The point $O_2$ is located at one-third of the length of the above-mentioned lateral edge as measured from the longitudinal edge of the paper sheet which is opposite to the edge 35. Likewise, the jogger fence 13 is movable along a line interconnecting the intermediate point $O_3$ of the other side edge of the paper sheet having the largest size and a point $O_4$ of the other side edge of the paper sheet having the smallest size. The point $O_4$ is also located at one-third of the length of the side edge as measured from the same longitudinal edge as the point $O_2$.

In the illustrative embodiment, the paper handling device 3 performs stapling or similar processing on the tray 11, as described in detail later. The processed paper sheets are taken out from the device 3 in a direction indicated by an arrow a in FIG. 2. With respect to this direction a, the jogger fences 12 and 13 are positioned at the rear and the front, respectively. In this sense, the jogger fences 12 and 13 will hereinafter be referred to as a rear and a front jogger fence, respectively.

Usually, the jogger fences 12 and 13 are held in a halt at stand-by positions outside of the laterally opposite edges of a paper sheet having the largest size (A3), as indicated by solid lines in FIG. 3. Means for sensing the size of paper sheets fed from the paper feeding section 5 is installed in the copier body 4. Assuming that such means has sensed the smallest paper size (B6), the motor 15 (FIG. 2) rotates the drive gear 16 and, therefore, the pulley 25 in a direction indicated by a solid arrow in FIG. 4. Consequently, the wire 31 rotates the rear jogger fence 12 as indicated by a solid arrow. At the same time, the rotation of the drive gear 16 is transmitted to the pulley 28 via the gears 17, 18 an 19 with the result that the front jogger fence 13 is moved via the wire 32 as indicated by a solid arrow.

Consequently, the pair of jogger fences 12 and 13 are moved symmetrically toward each other with respect to the widthwise center A as shown in FIG. 3. The jogger fences 12 and 13 reach or abuts against opposite side edges of paper sheets of size B6 to neatly regulate them by using at the widthwise center A for a reference, i.e., the jogger fences 12 and 13 locate the paper sheets at a center reference position. Such a movement of the jogger fences 12 and 13 occurs every time a paper sheet is driven out of the copier body 4. For example, when the second paper sheet is discharged from the copier body 4, the motor 15 (FIG. 2) is slightly reversed to move the jogger fences 12 and 13 away from the opposite side edges of the paper sheet of size B6. After the discharge of the second paper sheet, the jogger fences 12 and 13 are again moved toward each other to regulate the position of the paper sheet with respect to the center A. Such a movement of the jogger fences 12 and 13 will hereinafter be referred to as a jogging movement.

Figure 4:
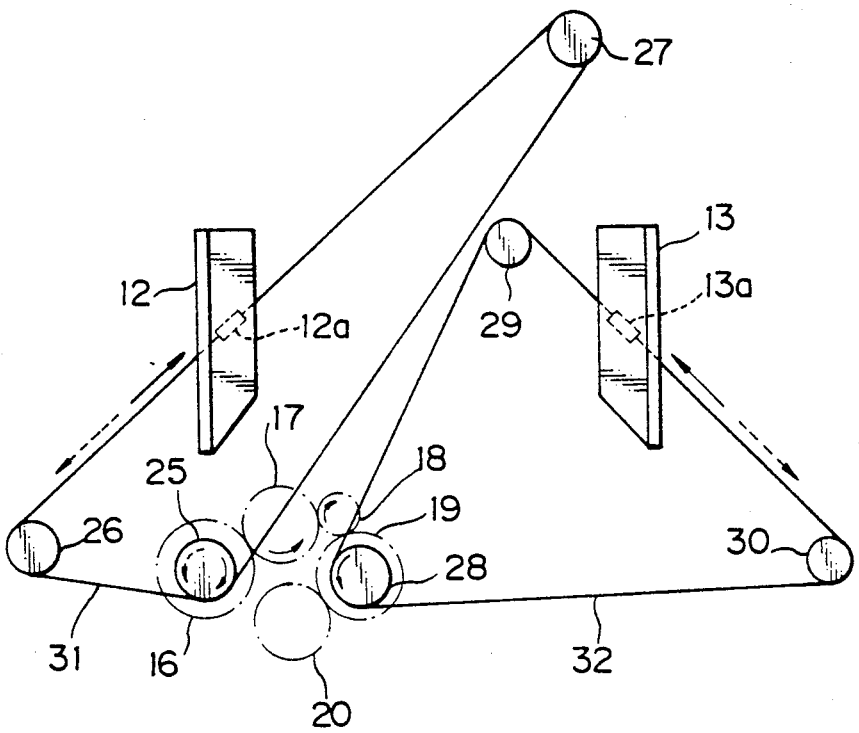
FIG. 4 is a view demonstrating jogging movements which occur in the construction shown in FIG. 2.

When the paper size is changed from a small size to a large size, the motor 15 is of course reversed to rotate the drive gear 16 in a direction indicated by a a phantom arrow in FIG. 4. This moves the jogger fences 12 and 13 away from each other as indicated by phantom arrows. As soon as the jogger fences 12 and 13 reach positions slightly outward of the discharged paper sheets, they are brought to a stop so as to begin the previously stated jogging movement there.

In any case, the jogger fences 12 and 13 locates the paper sheets at the center reference position while moving symmetrically to each other toward the center A. Since this movement of the jogger fences 12 and 13 occurs obliquely to and not perpendicularly to the intended direction of paper discharge, they urge the paper sheets against an upright wall 11*a* (FIG. 2) which extends from the tray 11 and thereby true up the edge 35 (FIG. 3) of the paper sheets. This kind of function is not achievable with joggers which are simply moved in a reciprocating motion perpendicular to the intended direction of paper discharge.

Figure 5:
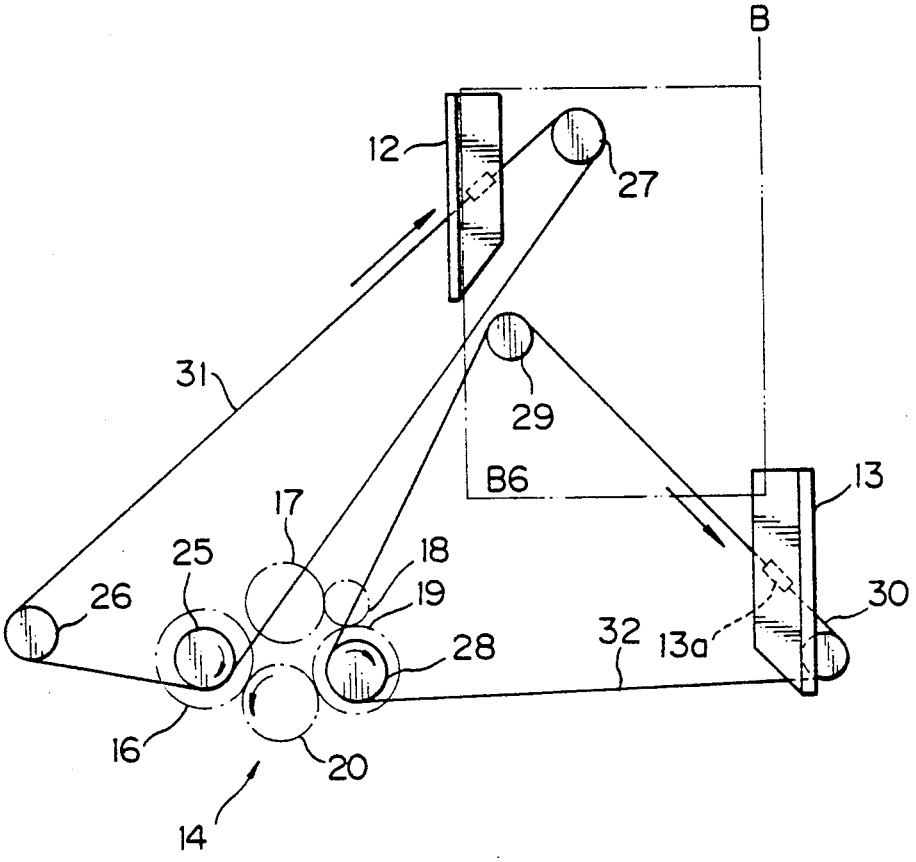
FIG. 5 is a view showing how paper sheets are shifted to a one-side reference position by the construction of FIG. 2.
Figure 6:
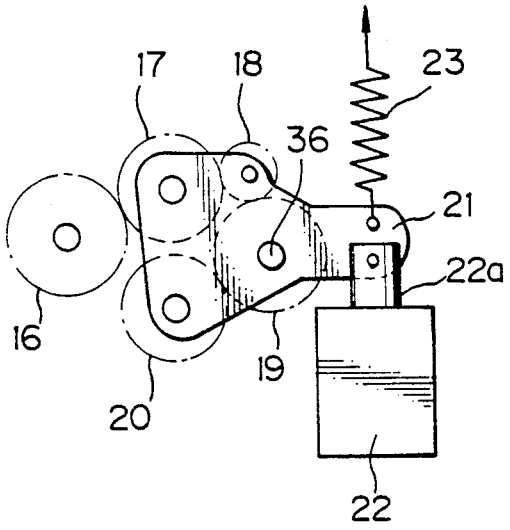
FIG. 6 is a plan view showing a specific construction of means for switching over the jogging movement and the shifting movement to the one-side reference position.

As shown in FIG. 6, the solenoid 22 has a plunger 22*a*. While the jogging movement is under way as stated above, the solenoid 22 is deenergized. In this condition, the gear mount 21 is urged about a fulcrum 36 by a spring 23 such that the gear 17 meshes with the drive gear 16. When the jogging operation is terminated, the solenoid 22 is energized so that the gear mount 21 is rotated clockwise about the fulcrum 36 as viewed in FIG. 6 against the action of the spring 23. As a result, the gear 17 is released from the drive gear 16 while the gear 20 is caused into mesh with the drive gear 16, as shown in FIG. 5. Then, the drive motor 15 rotates the drive gear 16 as indicated by an arrow and thereby moves the rear jogger fence 12 as also indicated by an arrow. When the size of paper sheets selected is B6, for example, the jogger fence 12 is moved beyond the center A to a position indicated by a phantom line in FIG. 3.

As the gear 20 is meshed with the drive gear 16 as stated above, the front jogger fence 13 is moved toward the pulley 30, i.e., retracted away from the side edge of the paper sheets by the gears 20 and 19, pulley 28 and wire 32. Then, the front jogger fence 13 is brought to a stop at the usual stand-by position.

The rear jogger fence 12 moving over the center A as described above shifts the paper sheets to the right as viewed in FIG. 3. When the paper sheets have the smallest size, the jogger fence 12 is brought to a stop at its outermost position. In this condition, the right side edge of the paper sheets of size B6 coincides with the right side edge of paper sheets having the largest size, i.e. A3. More specifically, the rear jogger fence 12 shifts the paper sheets to a one-side reference position where the right side edge of the paper sheets is located at a position B. In the same manner, paper sheets whose size ranges from A5 to B4 are shifted to the one-side reference position. It is to be noted that the front and rear jogger fences 12 and 13, i.e., the wires 31 and 32 are moved by the same amount as each other, whatever the paper size may be.

By the above procedure, a stack of paper sheets of any particular size are shifted from the center reference position to the one-side reference position in a neatly arranged condition. Hence, a stapler, for example, can bind the paper stack without being moved in the widthwise direction of the paper stack. In contrast, if the paper sheets are shifted to the one-side reference position without being regulated at the center reference position, it will be difficult to true them up at the one-side reference position.

Referring again to FIG. 2, a stapler 37 is usually held in a retracted position or inoperative position indicated by a solid line so as not to interfere with the discharge of paper sheets onto the tray 11. To bind paper sheets, the stapler 37 is advanced from the inoperative position to an operative position indicated by a phantom line in the figure. In the operative position, or a position E shown in FIG. 3, the stapler 37 binds the paper sheets on the tray 1. This position E remains the same with no regard to the paper size. If the paper sheets are left at the center reference position, the stapler 37 shown in FIG. 2 will have to be moved in a direction perpendicular to the double-headed arrow associated therewith and, moreover, the stapling position will differ from one paper size to another. In the illustrative embodiment, the stapler 37 needs only to be moved one-dimensionally. On completing the stapling operation, the stapler 37 is retracted to the inoperative position. The stapled paper stack is taken out of the tray 11 in the direction a (FIG. 2) and at the same position as the stapling position E.

In the case of paper sheets having the smallest size (B6), they will be moved by 84.5 millimeters from the center reference position to the one-side reference position. This distance is the displacement necessary for the paper sheets to reach the stapling position and is the maximum displacement of the jogger fences 12 and 13 for bringing the paper sheets to the stapling position.

Shifting a stack of paper sheets to the one-side reference position on the tray 11 as stated above is successful not only in simplifying the movement of a stapler or similar instrument but also in facilitating the removal of the paper stack from the tray 11. This is also true when paper sheets are taken out without being stapled or otherwise processed. Should the paper sheets be left at the center reference position, taking them out in the direction a (FIG. 3) would not be easy, especially when the paper size is small.

It is necessary to stop the rotation of the motor 15 (FIG. 2) as soon as a paper stack having a particular size is brought to the one-side reference position. This can be done by using a sensor (e.g. photosensor) responsive to the arrival of paper sheets at the position B, a sensor responsive to the position of the front jogger fence 13, or a sensor responsive to the position of the rear jogger fence 12 which varies with the paper size.

The rear jogger fence 12 moves obliquely while shifting paper sheets toward the one-side reference position, as stated earlier. Hence, the paper sheets are moved with their edge 35 (FIG. 3) abutting against and sliding along the upright wall 11*a* of the tray 11. Such a unique movement of paper sheets on the tray 11 prevents the paper sheets from being dislocated and thereby insures accurate stapling or similar processing.

As shown in FIG. 3, when paper sheets are removed from the tray 11 in the direction a, the front jogger fence 13 is held in the stand-by position. This facilitates the removal of paper sheets of small sizes which are of frequent use, especially sizes B6, A5 and B5 in the illustrative embodiment. Should the front jogger fence 13 be located at the intermediate between opposite ends of the side edge of paper sheets of size B5 or similar size often used, paper sheets of such a size cannot be taken out with ease.

While the present invention has been shown and described in relation to a copier, it is of course applicable to other various kinds of image forming apparatuses of the type shifting a stack of discharged paper sheets to a one-side reference position, e.g. facsimile machine and printer.

In summary, the present invention provides a paper handling device which shifts paper sheets having been discharged with their widthwise center being in register with a center reference to a one-side reference position while truing them up at a center reference position. The handling device, therefore, locates the paper sheets at the one-side reference position with accuracy to thereby promote accurate stapling or similar processing. Also, the device simplifies the movement of an instrument for implementing such processing. A stack of discharged sheets, whether they have been processed or not, can be readily taken out of the device with no regard to the paper size. Furthermore, the device has paper guide members which exert a force on paper sheets so as to enhance further accurate positioning of the latter.

Various modifications will become possible for those skilled in the art after receiving the teachings of the present disclosure without departing from the scope thereof.

What is claimed is:

1. A paper handling device for an image forming apparatus, comprising:

a tray for receiving a plurality of paper sheets sequentially driven out of said image forming apparatus while being positioned with the widthwise center of said paper sheets being located at a center reference; and a pair of paper guide members movable relative to said tray;

said pair of paper guide members being moved symmetrically toward each other with respect of said widthwise center along convergent guide paths which converge toward one transverse edge of said paper sheets to accommodate paper sheets of different sized widths and lengths, and to locate the paper sheets on said tray at a center reference position while moving said paper sheets in a direction for truing up one longitudinal edge of said paper sheets;

either one of said pair of paper guide members moving, when a plurality of paper sheets have been fully discharged, said paper sheets such that one lateral edge of said paper sheets coincides with a one-side reference position which is common to all paper sizes, while the other paper guide member moving away form said one lateral edge.

2. A device as claimed in claim 1, wherein said one paper guide member is movable on and along a line interconnecting substantially an intermediate point of one lateral edge of paper sheets having a largest size usable with said apparatus and a point of one lateral edge of paper sheets having a smallest size which is located at one-third of a length of said one lateral edge as measured from the other longitudinal edge opposite to said one longitudinal edge;

said other paper guide member being movable on and along a line interconnecting substantially an intermediate point of the other lateral edge of said paper sheets having the largest size and a point of the other lateral edge of said paper sheets having the smallest size which is located at one-third of a length of said other lateral edge as measured from said other longitudinal edge.

3. A paper handling device as claimed in claim 1, wherein said pair paper guide members are respectively held in a halt at stand-by positions located outside of lateral opposite edges of said paper sheets having a largest size.

4. A paper handling device as claimed in claim 3, wherein when a plurality of paper sheets have been fully discharged, said other paper guide member is held at said stand-by position.

* * * * *